US005393056A

United States Patent [19]

Richardson

[11] Patent Number: 5,393,056

[45] Date of Patent: Feb. 28, 1995

[54] ADJUSTABLE GOLF CLUB

[76] Inventor: Matthew H. Richardson, 23240 88th Ave. S., #EE-103, Kent, Wash. 98031

[21] Appl. No.: 216,354

[22] Filed: Mar. 23, 1994

[51] Int. Cl.[6] ..... A63B 53/06

[52] U.S. Cl. ..... 273/79; 273/80.1

[58] Field of Search ..... 273/79, 168, 80.1, 80.2; 403/103, 104, 106, 108, 83, 84, 97

[56] References Cited

U.S. PATENT DOCUMENTS

| | | | |
|---|---|---|---|
| 1,137,457 | 4/1915 | Breitenbaugh | 273/79 |
| 1,206,104 | 11/1916 | Goodrich | 273/79 |
| 1,605,140 | 11/1926 | Perkins | 273/79 |
| 2,475,926 | 7/1949 | Verderber | 403/84 |
| 2,661,952 | 12/1953 | Jackson | 403/84 |
| 2,708,579 | 5/1955 | Hugman | 273/79 |
| 2,777,694 | 1/1957 | Winter | 273/79 |
| 2,980,456 | 4/1961 | McMullin | 403/108 |
| 3,601,399 | 8/1971 | Agens | 273/79 |

FOREIGN PATENT DOCUMENTS

| | | | |
|---|---|---|---|
| 0118381 | 9/1984 | European Pat. Off. | 273/168 |
| 1048806 | 8/1953 | France | 273/79 |
| 9169 | of 1909 | United Kingdom | 273/79 |

*Primary Examiner*—Sebastiano Passaniti

[57] ABSTRACT

An Adjustable Golf Club including a series of golf club styles in a singular unit comprising a shaft member, a club head attachment member affixed to and orthogonal to the shaft member, a club head member pivoting about an axis orthogonally disposed to the shaft member, and a locking mechanism to establish the club head member at a fixed angular disposition relative to the pivotal axis of rotation.

3 Claims, 3 Drawing Sheets

FIG. 2
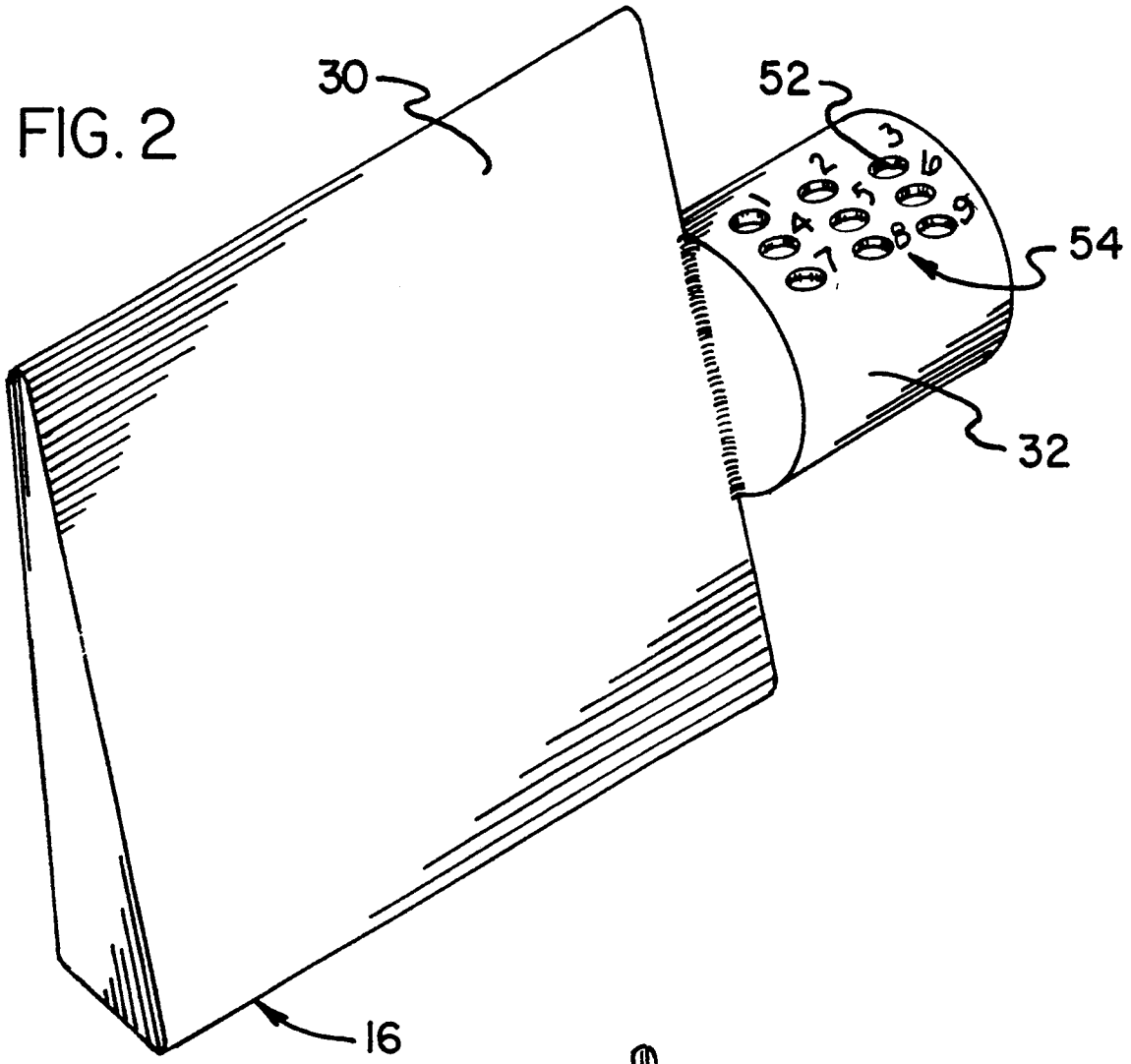
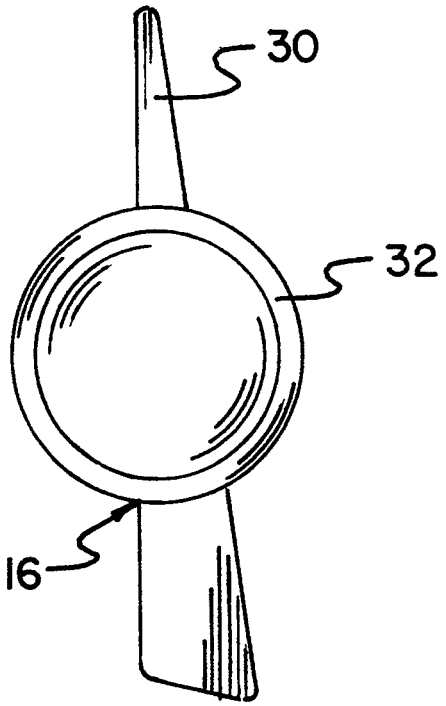
FIG. 3

ADJUSTABLE GOLF CLUB

BACKGROUND OF THE INVENTION

1. Field of the Invention

The present invention relates to golf clubs and more particularly pertains to an adjustable golf club which may be utilized for providing a wide range of functions ordinarily achieved by a set of clubs into a single adjustable club unit.

2. Description of the Prior Art

The use of an adjustable golf club is known in the prior art. More specifically, an adjustable golf club heretofore devised and utilized for the purpose of expanding the utility of a single golf club are known to consist basically of familiar, expected and obvious structural configurations, notwithstanding the myriad of designs encompassed by the crowded prior art which have been developed for the fulfillment of countless objectives and requirements.

For example, U.S. Pat. No. 3,430,957 to Andis discloses a locking golf club head adjustment in which the golf club head may be adjusted and locked in a wide range of angular dispositions wherein the adjustment sets the angle formed between the golf club shaft and level ground when the golf club head base is resting thereon. The present invention provides a locking adjustment for the golf club head wherein the angular adjustment is orthogonally disposed to that of the Andis patent and thereby provides the significant advantage of incorporating a set of golf clubs in a single golf club format.

In U.S. Pat. No. 5,039,098 to Pelz a golf club having an aligning and quick-connect-disconnect coupling between the golf club shaft and club head is disclosed. The Pelz patent has no intrinsic provision for angular adjustment of an attached golf club head and any change in golf club head angular disposition requires installation of a replacement golf club head. The present invention employs a single golf club head to achieve a wide range of angular dispositions thereby dismissing the need for a set of golf club heads to achieve equivalent results using the Pelz invention.

In U.S. Pat. No. 3,893,670 to Franchi a golf club with interchangeable heads is described. The Franchi patent has no provision for angular adjustment of an attached golf club head and any change in golf club head angular disposition requires installation of a replacement golf club head. The present invention employs a single golf club head to achieve a wide range of adjustment thereby eliminating the need for a set of golf club heads to achieve equivalent results.

In U.S. Pat. No. 3,424,459 to Evancho a golf club including interchangeable heads is disclosed for the purpose of providing the capability of using a single golf club shaft to engage any of several golf club heads wherein each head can provide differing features. A disadvantage in this prior art lies in the need to maintain a set of detachable golf club heads to provide a range of required head styles for even the novice golfer. The present invention eliminates the need for a multiplicity of golf club heads to satisfy practical golfing needs.

In U.S. Pat. No. 3,833,223 to Shulkin a golf club assembly having interchangeable inner flex members is described. The Shulkin patent discloses an adjustable golf club shaft providing an adjustable range of shaft flexibility. The present invention provides for the angular adjustment of the golf club head and is not related in any manner to shaft flexibility considerations.

As illustrated by the background art, efforts are continuously being made to attempt to improve golf clubs. No prior effort, however, provides the benefits attendant with the present invention. Additionally, the prior patents and commercial techniques do not suggest the present inventive combination of component. elements arranged and configured as disclosed and claimed herein.

Therefore, it can be appreciated that there exists a continuing need for an adjustable golf club which can be employed to provide a multiplicity of golf club functions in a single unit. In this regard, the present invention substantially fulfills this need.

The present invention achieves its intended purposes, objects, and advantages through a new, useful and unobvious combination of method steps and component elements, with the use of a minimum number of functioning parts, at a reasonable cost to manufacture, and by employing only readily available materials.

SUMMARY OF THE INVENTION

In view of the foregoing disadvantages inherent in the known types now present in the prior art, the present invention provides an improved and adjustable golf club construction wherein the same can be utilized for providing a multiplicity of golf club functions in a single unit. As such, the general purpose of the present invention, which will be described subsequently in greater detail, is to provide a new and improved adjustable golf club apparatus and method which has all of the advantages of the prior art adjustable golf club methods and none of the disadvantages.

The invention is defined by the appended claims with the specific embodiment shown in the attached drawings. For the purpose of summarizing the invention, the invention may be incorporated into an adjustable golf club having a pivoting club head with selectable stops which angularly position the club head face thereby providing selection of angular interaction of the face with the ball.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. In as much as the foregoing has outlined rather broadly the more pertinent and important features of the present invention in order that the detailed description of the invention may be better understood so that the present contribution to the art can be more fully appreciated. Additional features of the invention will be described hereinafter which form the subject of the claims of the invention. It should be appreciated by those skilled in the art that the conception and the disclosed specific methods and structures may readily be utilized as a basis for modifying or designing other structures for carrying out the same purposes of the present invention. It should be realized by those skilled in the art that such equivalent methods and structures do not depart from the spirit and scope of the invention as set forth in the appended claims.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

Therefore, it is an object of the present invention to provide a new and improved adjustable golf club.

An even further object of the present invention is to provide a new and improved adjustable golf club which is susceptible of a low cost of manufacture with regard to both materials and labor, and which accordingly is then susceptible of low prices of sale to the consuming public, thereby making such adjustable golf clubs economically available to the buying public.

Still yet another object of the present invention is to provide a new and improved adjustable golf club which provides in the apparatuses and methods of the prior art some of the advantages thereof, while simultaneously overcoming some of the disadvantages normally associated therewith.

Still another object of the present invention is to provide a new and improved adjustable golf club which serves a purpose of achieving a wide range of angular dispositions of the ball striking face thereby eliminating the need for a set of golf club heads.

Yet another object of the present invention is to provide a new and improved adjustable golf club which incorporates a replaceable and adjustable club head which facilitates more precision in launching the ball thereby providing the golfer with enhanced scoring capability.

Even still another object of the present invention is to provide a new and improved adjustable golf club thereby having a beneficial impact on the golfing industry in general.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

The foregoing has outlined some of the more pertinent objects of this invention. These objects should be construed to be merely illustrative of some of the more prominent features and applications of the present invention. Many other beneficial results can be attained by applying the disclosed invention in a different manner or by modifying the invention within the scope of the disclosure. Accordingly, other objects and a fuller understanding may be had by referring to the summary of the invention and the preferred embodiment in addition to the scope of the invention defined by the claims taken in conjunction with the accompanying drawings.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 2 is a perspective view of the golf club head.

FIG. 3 is a rear elevational view of the golf club head.

DESCRIPTION OF THE PREFERRED EMBODIMENT

Figures 1, 4:
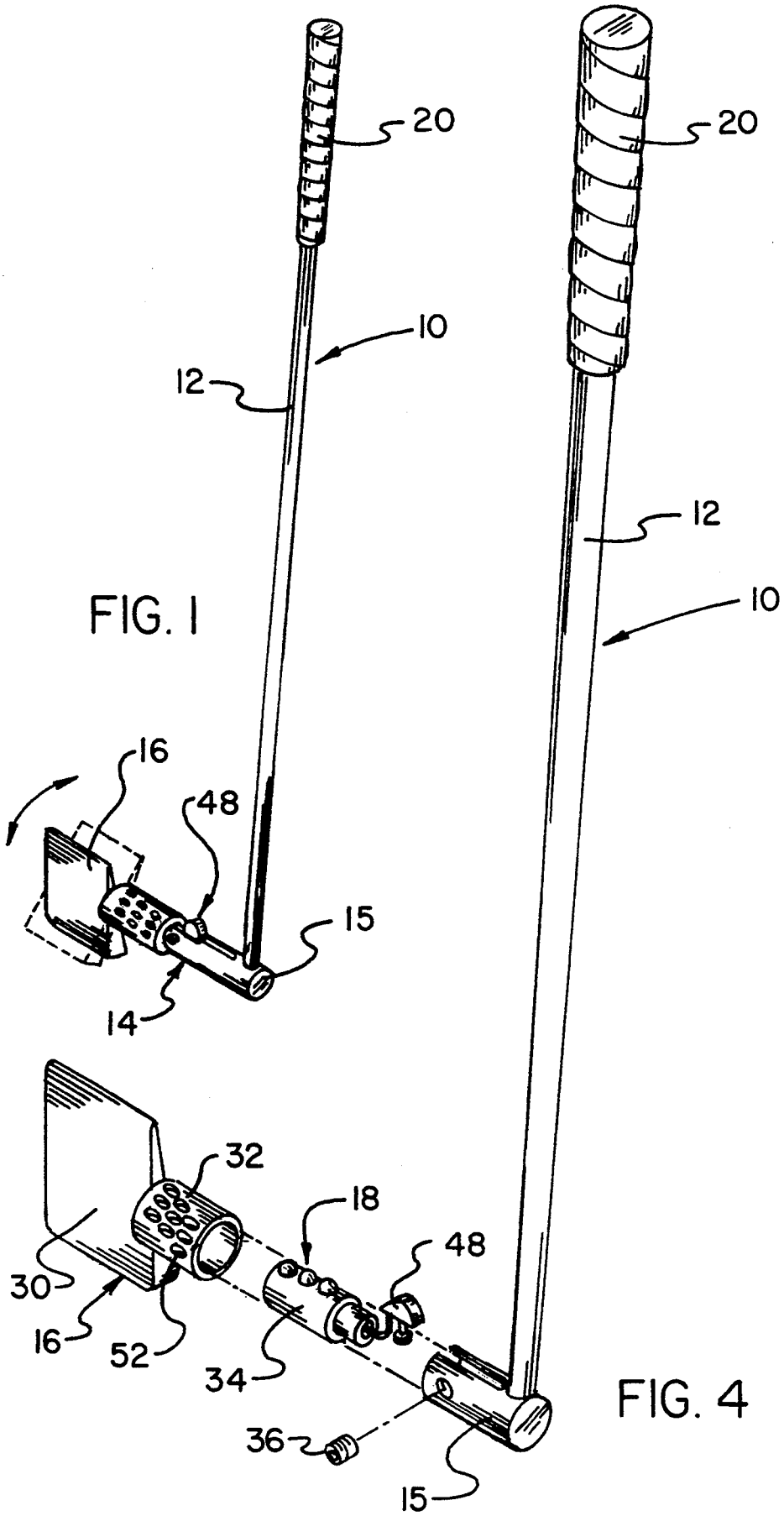
FIG. 1 is a perspective view of the adjustable golf club.
FIG. 4 is an exploded perspective view of the adjustable golf club.
Figure 5:
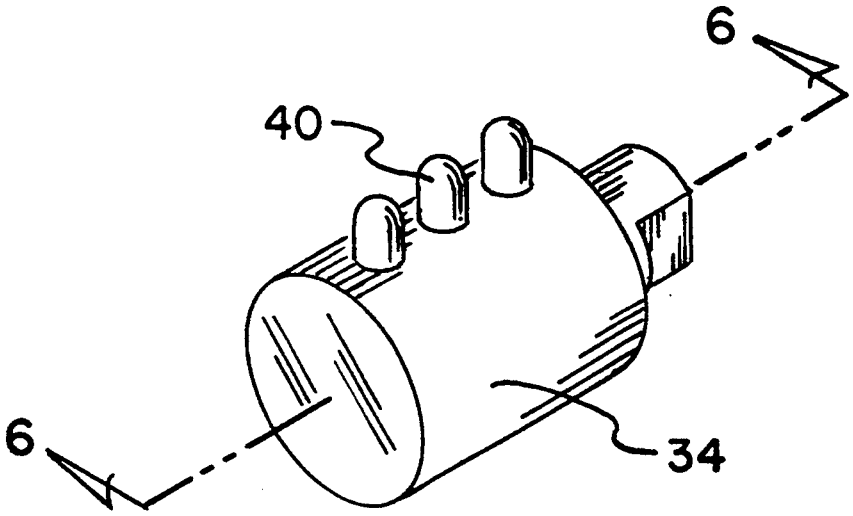
FIG. 5 is a side perspective view of the shaft mounted adjustment member.

With reference now to the drawings, and in particular to FIG. 1 thereof, a new and improved adjustable golf club head embodying the principles and concepts of the present invention and generally designated by the reference numeral 10 will be described.

From an overview standpoint, the adjustable golf club 10 is adapted for use by a human to provide the performance of several golf club types in a single club unit comprising a shaft 12, interconnecting an adjustable club head 16. See FIG. 1. Club head 16 is manually rotated to the angle desired then locked in place by locking mechanism 18.

More specifically, it will be noted that the adjustable golf club 10 comprises a shaft portion 12, a club heat attachment member 14, a club head member 16, and a locking mechanism 18 which engages club head member 16. Shaft portion 12 comprises any of a number of common golf club shaft designs terminating at one end in handgrip 20 and terminating at the opposite end in a club head attachment member 14. Club head member 16 comprises a substantially wedge shaped portion 30 materially composed of metal, wood, or composite as is generally employed in golf clubs known as "irons" or "woods" and a perforated hollow cylindrical portion 32 affixed to wedge shaped portion 30. See FIG. 3. Perforated hollow cylindrical portion 32 pivots about shaft 34 of club head attachment member 14.

Figure 6:
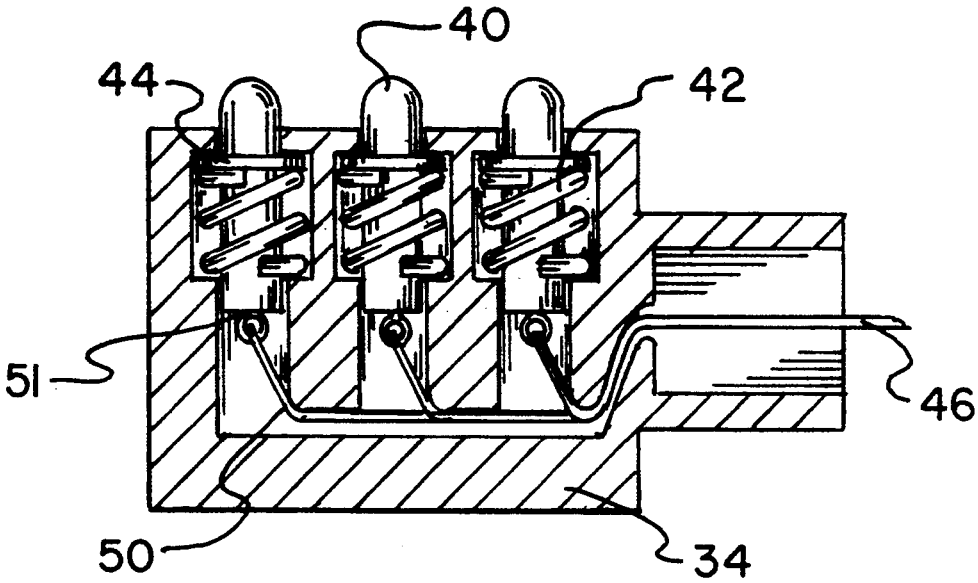
FIG. 6 is a fragmentary sectional view of the shaft mounted adjustment member taken substantially in the plane defined by the section lines 6—6.

Shaft 34 engages club head attachment member housing 15 and is locked in position by setscrew 36. See FIG. 4. Locking member 18 comprises a plurality of rounded cylinders 40 arranged in a linear fashion and in alignment with the shaft 34 axis. See FIG. 6. Cylinder 40 is maintained in an extended position by spring 42 acting on washer 44 which are affixed to cylinder 40. Spring force on cylinder 40 and washer 44 may be overcome by external application of tension on retractor 46. Retraction tension is applied by application of an external force which moves slider 48 of FIG. 4 toward the golf club shaft 12. Retractor 46 comprises a plurality of tension members 50 which attach to the base 51 of cylinder 40.

All tension members 50 are joined and operated by slider 48. The plurality of perforations 52 in cylinder 32 are held in a precise arrangement and may be numbered 54 according to the type of golf club emulated by the angular disposition of member 30 about the axis of shaft 34. In golfing practice regarding the use of standard "irons", for example, each angular position of member 30 differs from an adjacent position by five degrees over a range of thirteen degrees to fifty three degrees. Three rows and three columns of perforations 52 are required to position and lock club head member 16 in any one of the nine angular positions described in the foregoing.

Each of the three rows of perforations 52 is angularly disposed to the axis of cylinder 32 thereby forming a portion of a helix. The helical arrangement of perforations 52 permits engagement of a single cylinder 40 with a single perforation 52. Perforations 52 are of sufficient diameter to permit cylinder 40 engagement resulting in locking of club head member 16. Release from one angular disposition of club head member 16 to obtain another position is effected by moving slider 48 thereby retracting any cylinder 40 which is engaging any perforation 52.

In an alternate embodiment a cup shaped spring and locking lip locks club head member 16 to club head attachment member 14 by forcing a plurality of balls into sockets defining thee angular disposition of 16. Release and repositioning is effected by applying an external force to the spring.

In another alternate embodiment a circular tooth arrangement in the club head member 16 engages a similar tooth arrangement in club head attachment member 14 the whole being held in the appropriate angular relation by a spring member. Release and repositioning is effected by using mechanical advantage against the spring member.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention. In as much as the present disclosure includes that contained in the appended claims as well as that of the foregoing description. Although this invention has been described in its preferred forms with a certain degree of particularity, it is understood that the present disclosure of the preferred form has been made only by way of example and numerous changes in the details of construction and combination and arrangement of parts may be resorted to without departing from the spirit and scope of the invention.

What is claimed as being new and desired to be protected by LETTERS PATENT of the United States is as follows:

1. A new and improved adjustable golf club for incorporating a series of golf club styles in a singular unit comprising:

a shaft member having a longitudinal axis, a club head attachment member affixed to said shaft member, said club head attachment member being disposed within a first plane orthogonally oriented relative to a second plane containing said longitudinal axis of said shaft member, a club head member pivoting about an axis orthogonally disposed relative to said second plane containing said longitudinal axis of said shaft member, and a locking means to establish the club head member at a fixed angular disposition relative to the pivotal axis of rotation, said locking means comprising a plurality of spring energized cylindrical pins engaging holes in the club head attachment member, said holes in the club head attachment member comprising through-extending holes on a cylindrical member arranged as a nine element array having a plurality of array columns and array rows.

2. The new and improved adjustable golf club of claim 1 in which said array rows are displaced from one another by an amount equal to one half the distance between centers of any two holes in any of the array columns.

3. The new and improved adjustable golf club of claim 1, and further comprising a plurality of tension members each coupled to an individual one of said cylindrical pins, wherein said locking means is disengaged by an application of an external force to said tension members and further wherein said tension members transmit force from a single external activation source.

* * * * *